US006393637B1

(12) United States Patent
Hoffman

(10) Patent No.: US 6,393,637 B1
(45) Date of Patent: May 28, 2002

(54) MULTIPURPOSE PERSONAL COVER

(76) Inventor: Kathryn Hoffman, 87 S. Finley Ave., Basking Ridge, NJ (US) 07920

( * ) Notice: Subject to any disclaimer, the term of this patent is extended or adjusted under 35 U.S.C. 154(b) by 0 days.

(21) Appl. No.: 09/520,036

(22) Filed: Mar. 7, 2000

(51) Int. Cl.[7] ..... A47G 9/08

(52) U.S. Cl. ..... 5/413 R; 5/417; 5/485; 2/69.5

(58) Field of Search ..... 5/413 R, 413 AM, 5/417, 418, 419, 420; 2/69, 69.5

(56) References Cited

U.S. PATENT DOCUMENTS

| | | | | | |
|---|---|---|---|---|---|
| 2,611,899 | A | * | 9/1952 | Nelson | 5/485 |
| 2,644,948 | A | * | 7/1953 | Gutmann | 2/69.5 |
| 2,711,546 | A | * | 6/1955 | Licht | 5/485 |
| 2,972,757 | A | * | 2/1961 | Adrian | 2/69.5 |
| 3,176,315 | A | * | 4/1965 | Freund | 5/419 |
| 3,381,306 | A | * | 5/1968 | Innes | 5/417 X |
| 3,477,552 | A | * | 11/1969 | Goldman | 5/413 R X |
| 3,510,889 | A | * | 5/1970 | Peterson | 5/413 R |
| 3,958,274 | A | * | 5/1976 | Klauber | 2/69 |
| 4,180,867 | A | * | 1/1980 | Ridgeway, Jr. | 2/89 |
| 4,238,871 | A | * | 12/1980 | Cannon | 2/69.5 |
| 4,484,362 | A | * | 11/1984 | Asher | 5/413 R X |
| 4,513,461 | A | * | 4/1985 | Tardivel | 5/413 R |
| 4,604,765 | A | * | 8/1986 | Scholtz | 5/413 AM |
| 4,634,618 | A | * | 1/1987 | Greer et al. | 5/417 X |
| 5,217,034 | A | * | 6/1993 | Yih et al. | 5/419 X |
| 5,346,308 | A | * | 9/1994 | Buhot et al. | 5/417 X |
| 5,390,381 | A | * | 2/1995 | LaMantia | 5/417 |
| 5,454,125 | A | * | 10/1995 | Ratkowski | 5/417 |
| 5,454,643 | A | * | 10/1995 | Sullivan | 383/4 |
| 5,463,783 | A | * | 11/1995 | Pope | 5/417 |
| 5,618,110 | A | * | 4/1997 | Sullivan | 383/4 |
| 5,774,912 | A | * | 7/1998 | Dominique | 5/417 X |
| 5,920,931 | A | * | 7/1999 | Zuehlke et al. | 5/419 |
| 5,987,667 | A | * | 11/1999 | Haverly et al. | 5/417 X |
| 6,014,772 | A | * | 1/2000 | Connelly | 2/69 |
| 6,105,168 | A | * | 8/2000 | Hazen | 2/69.5 |
| 6,105,188 | A | * | 8/2000 | Perez-Mesa et al. | 5/417 X |
| 6,129,452 | A | * | 10/2000 | Hakulin | 5/417 X |
| 6,158,068 | A | * | 12/2000 | Pariseau | 5/413 R |
| 6,338,173 | B1 | * | 1/2002 | Ramsey | 5/413 R |

* cited by examiner

*Primary Examiner*—Robert G. Santos
(74) *Attorney, Agent, or Firm*—Thomas L. Adams

(57) ABSTRACT

A multipurpose article can provide a sleeping bag and personal cover. The article includes a planar flexible body having a peripheral fastener arranged to hold the flexible body in a folded condition to form a sleeping bag. The flexible body has an opening sized to permit passage of a person's head through the flexible body, so the flexible body can be worn on the person's shoulders. The flexible body also has a pouch arranged to be inverted in order to store the flexible body in a gathered condition.

45 Claims, 4 Drawing Sheets

FIG. 1
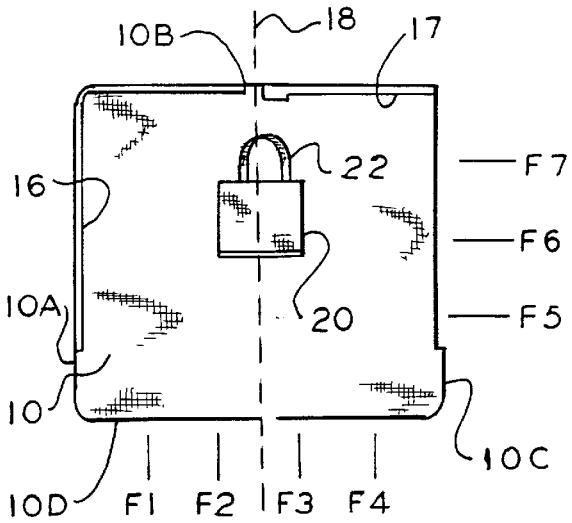
FIG. 2
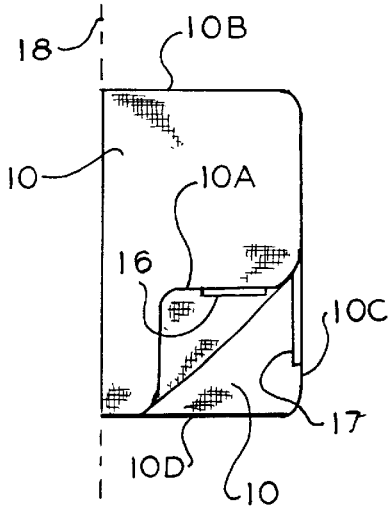
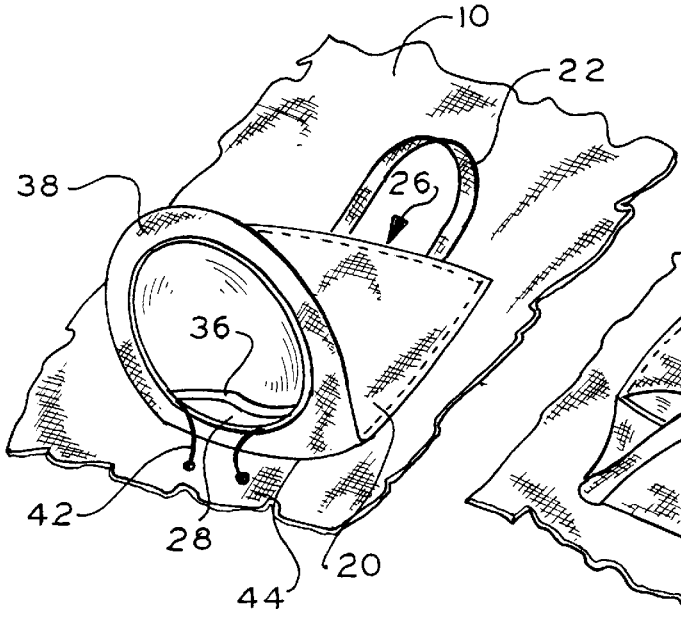
FIG. 3
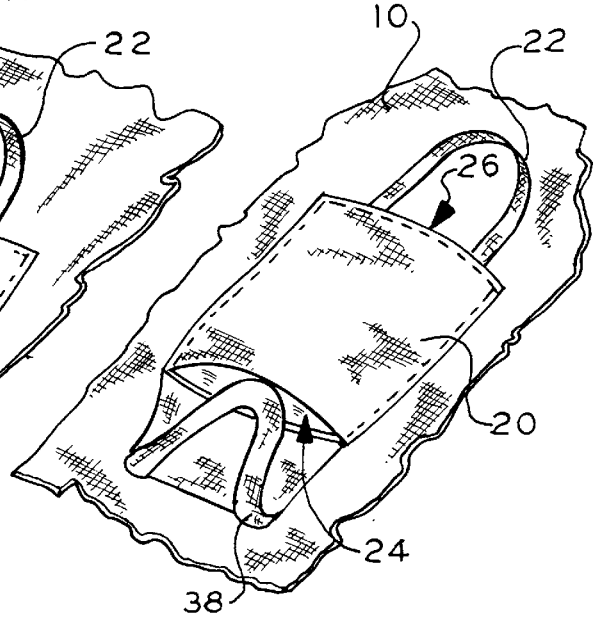
FIG. 4

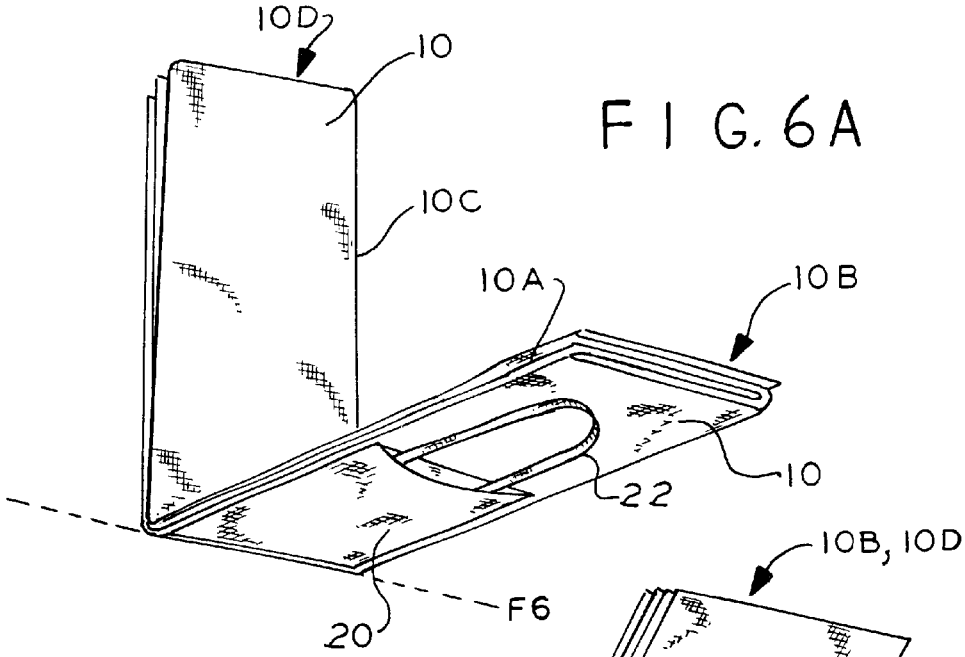
FIG. 6A
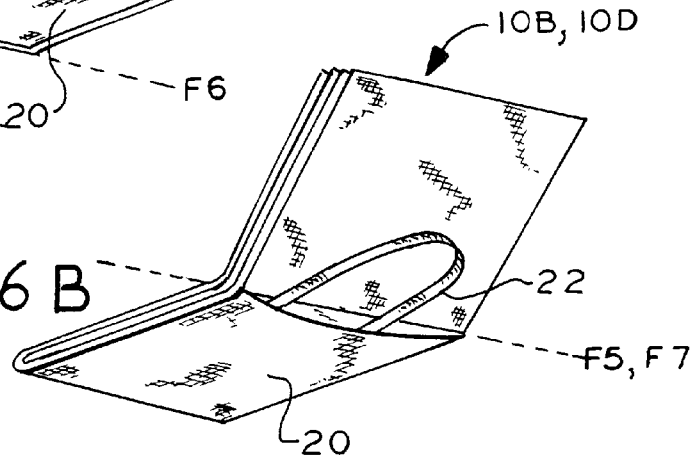
FIG. 6B
FIG. 6C
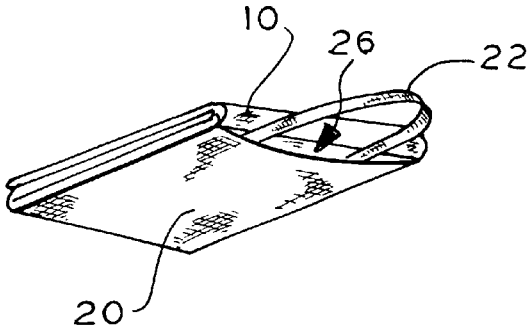
FIG. 6D
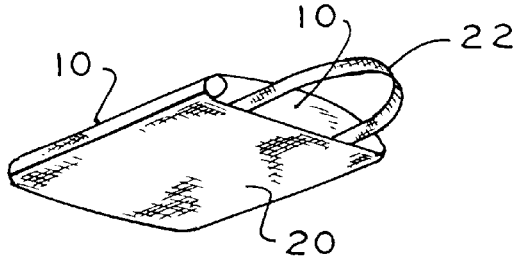

MULTIPURPOSE PERSONAL COVER

BACKGROUND OF THE INVENTION

1. Field of the Invention

The present invention relates to personal covers, and in particular to covers that have multiple purposes.

2. Description of Related Art

Hikers, campers, and other persons engaged in outdoor activities, including attending sporting events, often carry a variety of articles that offer creature comfort or deal with inclement weather. Such people may carry a hooded poncho, sleeping bag, and seat cushion. A collection of these articles is relatively bulky, and the bulk may include a pack or bag to carry these articles.

In U.S. Pat. No. 5,588,749 a large sheet can be removed from a separate carrying case. In one configuration, a separate hood can be attached by a zipper to an edge of the sheet to make a hooded poncho that will be open in the front and therefore, not very weather tight. In another configuration the hood is not used and the sheet is folded in half and closed by a zipper to form a sleeping bag. Unfortunately, this arrangement has three distinct items that can be separated and lost.

In U.S. Pat. No. 5,884,331 a rectangular panel stitched to the edge of a larger rectangular blanket is used as a hood when the larger blanket is draped around a person as a poncho. The blanket has a waterproof outer layer and an inner layer made of cotton or fleece. A pocket located next to the hood panel has an opening for storing the hood and an opposite opening that can be inverted for the purpose of storing the blanket. With this arrangement the poncho must be tied in the front thereby leaving it somewhat exposed to the weather. Also, this blanket is not arranged to be used as a sleeping bag. See, U.S. Pat. No. 5,414,881 for an arrangement having a hood and means for storing the hood. See also U.S. Pat. No. 5,454,125 for a blanket with a pocket that can be inverted for storing the blanket.

See U.S. Pat. No. 4,078,264 for a hooded cape having an integral storage compartment into which the cape can be folded to form a cushion. See also U.S. Pat. No. 2,109,951 for a hooded garment that opens in front and can be folded into a seat cushion. See the following U.S. Pat. Nos. Design: D258,035; D300,784; D305,844; D306,543; D310,149; D312,371; D313,142; D316,791; D322,532; D328,665; D336,986; D341,979; D359,718; and D383,634. See also U. S. Pat. Nos. 3,041,638; 4,188,988; 4,534,065; 4,466,516; 4,597,605; 4,752,971; 5,048,975; 5,103,515; 5,136,738; 5,179,741; 5,346,308; 5,421,045; 5,463,783; 5,481,768; 5,533,653; 5,730,529; and 5,843,556.

Accordingly, there is a need for an article that can be readily converted to offer different utilities, without being bulky, difficult to carry, or composed of distinct parts that are easily separated and lost.

SUMMARY OF THE INVENTION

In accordance with the illustrative embodiments demonstrating features and advantages of the present invention, there is provided a multipurpose article for providing a sleeping bag and personal cover. The article has a planar flexible body with a peripheral fastener arranged to hold the flexible body in a folded condition to form a sleeping bag. The flexible body has an opening sized to permit passage of a person's head through the flexible body.

According to another aspect of the invention a multipurpose article for providing a convertible personal cover again has a planar flexible body with an opening sized to permit passage of a person's head through the flexible body. The flexible body has a pouch arranged to be inverted in order to store the flexible body in a gathered condition.

According to still another aspect of the invention, a multipurpose article can provide a convertible sleeping bag. The article has a planar flexible body with a pouch arranged to be inverted in order to store the flexible body in a folded condition. The flexible body has a peripheral fastener arranged to hold the flexible body in a folded condition about a fold line to form a sleeping bag.

According to yet another aspect of the invention, a method can provide a sleeping bag and personal cover with a planar flexible body having an opening. The method includes the step of placing the flexible body on a person's shoulders with the person's head passing through the opening of the flexible body. Another step is removing the flexible body from the person's shoulders. The method also includes the step of folding the flexible body and peripherally fastening it to form a sleeping bag.

By employing an article and method according to the principles of the present invention, a person has an improved ability to use multiple features with a unitary article. In a preferred embodiment, a panel with a waterproof side can be folded in half and secured with a peripheral zipper to form a sleeping bag. A preferred pouch with a carrying handle can be secured on the side of the panel opposite the waterproof side.

In this preferred embodiment, a central opening in the panel, normally secured by a hook and loop fastener, can be opened. Then, the panel can be worn on the person's shoulders with the head passing through the opening. A preferred hood, stitched at the opening, can be pulled out of an auxiliary pocket in the pouch, pushed through the opening, and turned inside out. The hood can be placed over the person's head and cinched with a drawstring.

For storage or seating purposes, the preferred panel can be folded into a package the same size as the pouch, leaving the pouch exposed. The pouch can then be inverted so that the folded panel is contained inside the inverted pouch. Once packed in this fashion, the article can be readily carried or used as a seat cushion.

BRIEF DESCRIPTION OF THE DRAWINGS

The above brief description as well as other objects, features and advantages of the present invention will be more fully appreciated by reference to the following detailed description of presently preferred but nonetheless illustrative embodiments in accordance with the present invention when taken in conjunction with the accompanying drawings, wherein:

FIG. 1 is a plan view of an article in accordance with principles of the present invention;

FIG. 2 shows the article of FIG. 1 folded and secured with a fastener to form a sleeping bag;

FIG. 3 is a fragmentary, detailed view of the pouch of FIG. 1 with a hood deployed from an auxiliary pocket in the pouch;

FIG. 4 is a fragmentary, detailed view of the pouch of FIG. 3 showing the hood being packed into (or removed from) the auxiliary pocket;

FIGS. 6A–6D show a method of folding the article of FIG. 1 and inverting its pouch to store its flexible body;

DETAILED DESCRIPTION OF THE PREFERRED EMBODIMENTS

Figure 5A:
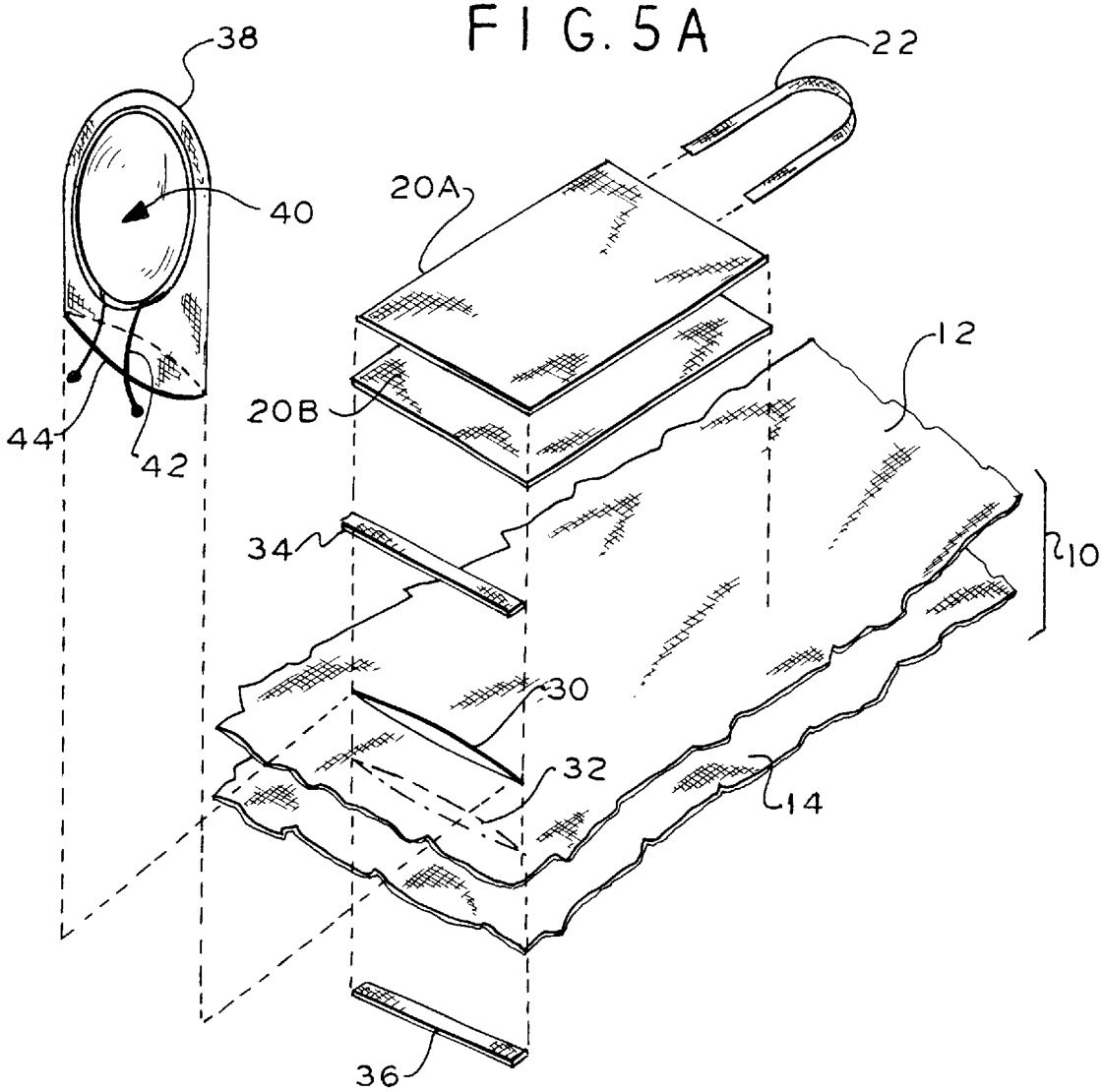
FIG. 5A is an exploded, fragmentary view of the article of FIG. 3.

Referring to FIGS. 1–5, a multipurpose article is shown as a planar flexible body 10 having a fabric layer 12 overlaying a waterproof layer 14. In one embodiment layer 12 is fleece, while waterproof layer 14 is a plastic sheet; although other fabrics and other waterproof sheets may be used instead. Also, in some embodiments a single layer may be used or a fabric layer may be coated with a waterproof material.

The detachable halves 16 and 17 of a zipper (referred to herein as a peripheral fastener) act as complementary linking devices. The zipper half 16 is shown attached to the periphery of body 10 along a portion of edge 10A and a portion of edge 10B. The zipper half 17 is shown attached to the periphery of body 10 along a portion of opposite edge 10C and a portion of edge 10B. The zipper halves 16 and 17 are both attached to disjoint portions of common edge 10B, on opposite sides of a central fold line 18 that runs lengthwise.

As shown in FIG. 2, flexible body 10 has been folded along fold line 18 to bring edges 10A and 10C together thereby allowing zipper halves 16 and 17 to mate, in order to form a sleeping bag that can be closed by the zipper, except along edge 10D. The overall dimensions of flexible body 10 and therefore the size of the sleeping bag of FIG. 2 can be varied depending upon the expected size of the user, the desired amount of space, etc.

Figure 5B:
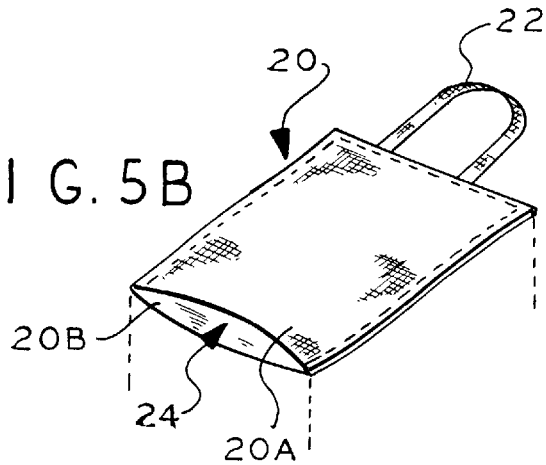
FIG. 5B is a detailed view of the pouch elements of FIG. 5A assembled, but not attached to the underlying flexible body.
Figure 7:
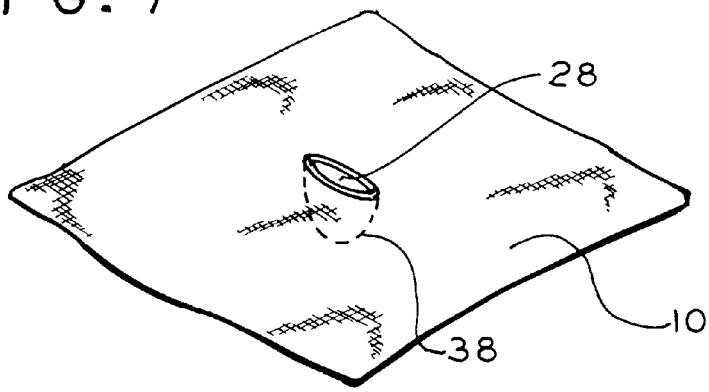
FIG. 7 shows the reverse side of the article of FIG. 1, its opening, and, in phantom, the hood prior to being pushed through the opening.

A pouch 20 is shown attached to flexible body 10 to straddle fold line 18. FIGS. 5A and 5B show pouch 20 formed of a layer 20A overlying an inner layer 20B. Preferably, layers 20A and 20B are made of a fleece fabric and sheet plastic, respectively, although different materials can be used in other embodiments.

A carrying handle is sandwiched between overlapping edges of layers 20A and 20B, which are stitched together. All of the overlapping edges of layers 20A and 20B are stitched together except for the edges opposite handle 22. Accordingly, the resulting opening between layers 20A and 20B forms an auxiliary pocket 24. Pouch 20 is attached to body 10 so that (a) all edges of layer 20B are stitched to body 10, except for the edge carrying handle 22; and (b) all edges of layer 20A are stitched to body 10, except for the edge opposite handle 22. Consequently, pouch 20 provides previously mentioned auxiliary pocket 24 and a main pocket 26. Main pocket 26 provides an opening between pouch 20 and flexible body 10 at the end carrying handle 22. Pockets 26 and 24 are herein referred to as a first one and a second one, respectively, of a pair of layered pockets.

An opening 28 is formed in flexible body 10 by cutting a slit 30 in layer 12 and a slit 32 to in layer 14. Slits 32 and 32 are made adjacent and parallel to the edge of pouch 20 opposite handle 22. A closure device is shown herein as a complementary pair of hook and loop fasteners 34 and 36. Fasteners 34 and 36 are stitched to opposite faces of flexible body 10 on opposite sides of the opening 28 formed by slits 30 and 32. Specifically, fastener 34 is placed on layer 12 between slit 30 in pouch 20 and stitched to both layers 12 and 14. Fastener 36 is placed on layer 14 on the side of slit 30 opposite pouch 20 and stitched to layers 12 and 14. Accordingly, fasteners 34 and 36 can reach each other through opening 28 in order to mate.

In more developed embodiments, the slits 30 and 32 will be appropriately reinforced. For example, a binding strip may be placed as a loop in opening 28, folded back on either side of flexible body 10, and stitched in place to form a binding. This binding may be elaborated and may have a separate component extending from opening 28 to form a short collar having Velcro™ fasteners on opposing faces.

A hood 38 may be a double layered body made of the same components as layers 12 and 14. The external layer may be sheet plastic while the internal layer may be a fleece fabric (although the foregoing is reversed in FIGS. 3, 4, 5A, and 5B where the hood is shown inside out). A face opening 40 is encircled by a hemmed-in drawstring 42 that can restrict opening 40. The lower border 44 of hood 38 is stitched contiguously around opening 28.

To facilitate an understanding of the principles associated with the foregoing article of FIGS. 1–5B, its operation will be briefly described, with reference to the methods illustrated in FIGS. 6A–6D, 7, and 8. The article may be used as a sleeping bag by folding flexible body 10 along fold line 18 (FIG. 1) to bring zipper halves 16 and 17 together as shown in FIG. 2. The zipper halves 16 and 17 may then be fastened in the usual manner to provide a sleeping bag that is essentially closed on all sides except along edge 10D. The zipper is shown partially opened along edges 10A and 10C to allow the user a little more ventilation and freedom of movement. The zipper can be more fully opened when the user wishes to exit the sleeping bag.

The article may be folded and converted into a seating cushion by following the steps shown in FIGS. 6A–6D. Reference should also be made to FIG. 1 where fold lines F1, F2, F3 and F4 and edges 10A and 10C constitute equidistant lines dividing flexible body 10 into five equal columns. Similarly, fold lines F5, F6, and F7 and edges 10B and 10D constitute equidistant lines dividing flexible body 10 into four equal rows. Consequently, the surface a flexible body 10 is thereby divided into a 5×4 matrix or checkerboard, although other arrangements are contemplated.

It will be noted that each of these cells of the matrix are squares having about the same dimension as pouch 20. Also, fold line 18 is equidistant between fold lines F2 and F3 and equidistant between edges 10A and 10C. The edge of pouch 20 opposite handle 22 is contiguous with fold line F6. In fact, the four edges of pouch 20 are contiguous with fold lines F2, F3, F6, and F7.

In a first longitudinal fold, flexible body 10 may be folded along fold line F2 (FIG. 1) lengthwise. This is performed by placing flexible panel 10 with the pouch 20 down, lifting edge 10A, and placing (a) edge 10A approximately at fold line F4, and (b) fold line F1 approximately at fold line F3.

In a second longitudinal fold, edge 10C is lifted (thereby lifting edge 10A) and simultaneously folding along fold lines F3 and F1. In a third longitudinal fold, edge 10C is again lifted and folded on fold line F4.

The outcome of this folding process can be further understood by reviewing folded edge 10B as shown in FIG. 6A. This Figure shows that the folded package has a width that is about the same as the width of pouch 20. It will be understood that many other folding schemes are possible but it is desirable that the chosen folding scheme result in a package that has the same width as pouch 20 and leaves pouch 20 exposed.

The folded package of FIG. 6A is shown being further folded in half, width-wise, along fold line F6 (fold line F6 also shown in FIG. 1) by lifting edge 10D. Since the package had an overall length about four times the length of pouch 20, after folding the package will have a length twice that of pouch 20, as shown in FIG. 6B. A final, width-wise fold along fold lines F5 and F7 (fold lines also shown in FIG. 1) is illustrated by the transition from FIG. 6B to FIG. 6C.

This completed package has approximately the same length and width as pouch 20 and leaves pouch 20 exposed. Again, many other folding schemes are possible, but it is desirable that the chosen folding scheme result in a package that has the same length and width as pouch 20 and leaves pouch 20 exposed. While compact folding procedures are preferred, flexible body 10 can even be gathered together behind pouch 20 in a random, crumpled bunch.

Assuming for now the configuration shown in FIG. 6C, this package will unfold if one attempts to carry it using handle 22. Therefore, the user now ought to invert pocket 26 of pouch 20 so that the folds of flexible body 10 are captured inside the pocket as shown in FIG. 6D. The resulting package can be conveniently carried using handle 22 without unfolding. Also, the package can be used as a seat cushion, for example, when the user is seated outdoors at a sporting event.

In the event of rain or inclement weather, the user may reverse the previous inversion of pouch 20 (FIG. 6D) and unfold the flexible body 10 back to the configuration shown in FIG. 1. The user may now reach into the auxiliary pocket 24 (FIG. 4) and pull out hood 38. The user will then unfasten the hook and loop fasteners 34 and 36 (FIGS. 3 and 5A) to open the opening 28 in order to achieve the interim condition shown in FIGS. 3 and 7. Next, the user will push hood 38 through opening 28 so that the hood extends from the waterproof side of flexible body 10. Also, the hood will be inverted to expose its waterproof side.

Figure 8:
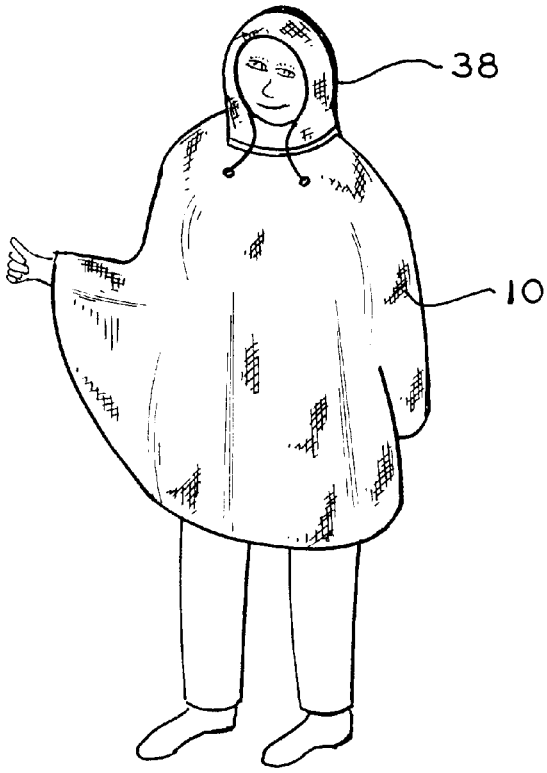
FIG. 8 shows the article of FIG. 1 being worn on the shoulders of a person with the person's head passing through the opening and into the hood.

The flexible body 10 now be placed over a user's shoulders, with the user's head passing through opening 28 as shown in FIG. 8. Accordingly, flexible body 10 and hood 38 act as a hooded poncho. Significantly, the hood 38 is centered on the flexible body 10. Thus, the article is closed in front and drapes by the same amount in both the front and back.

When this poncho is no longer needed, the user can remove the article and push hood 38 back through opening 28 before resealing fasteners 34 and 36. Hood 38 can then be stuffed back into auxiliary pocket 24 as shown in FIG. 4. This returns the article to the condition shown in FIG. 1. As described before, the article can either be converted to the sleeping bag of FIG. 2 or the compact package of FIG. 6D.

It is appreciated that various modifications may be implemented with respect to the above described, preferred embodiment. While the flexible body is shown with double layers, in other embodiments a different number of layers or single layer may be employed. As an example, an insulating material may be placed between two outside layers. Also, the illustrated fasteners can be replaced with a variety of zippers, snaps, hook and loop fasteners, buckles, laces, catches, etc. Also in some embodiments, the hood may be eliminated or made removable by employing releasable fasteners. Similarly, the auxiliary pocket for storing the hood can be eliminated in some embodiments. Also the carrying handle can take a variety of forms, may be removable, or may be eliminated altogether. Furthermore, in some embodiments the pouch may be placed next to a different portion of the opening, or in some cases, may be spaced from the opening. Moreover, the various dimensions and shapes can be altered depending upon the desired capacity, size, or other design considerations.

Obviously, many modifications and variations of the present invention are possible in light of the above teachings. It is therefore to be understood that within the scope of the appended claims, the invention may be practiced otherwise than as specifically described.

What is claimed is:

1. A multipurpose article for providing a sleeping bag and personal cover, comprising:

a planar flexible body having in an unfolded condition four peripheral edges consisting of a first, a second, a third, and a fourth peripheral edge, said first and said third peripheral edges being transverse to both said second and said fourth peripheral edges, said flexible body having a peripheral fastener arranged to hold said flexible body in a folded condition along a fold line that is spaced from said second and fourth peripheral edges and intersects said first and said third peripheral edges to form a sleeping bag with three closed edges and one open edge, said one open edge being formed with said third peripheral edge, said peripheral fastener being operable to form said three closed edges by joining together at least portions of said first, said second and said fourth peripheral edges, said flexible body having an opening sized to permit passage of a person's head through said flexible body at a position along said fold line that is spaced from said peripheral fastener and from said four peripheral edges, said peripheral fastener having a pair of complementary linking devices separately located on opposite sides of said fold line, said pair of linking devices comprising (a) a first linking device at least partially extending along said second peripheral edge and half of said first peripheral edge, and (b) a second linking device at least partially extending along said fourth peripheral edge and half of said first peripheral edge.

2. A multipurpose article according to claim 1 wherein said peripheral fastener comprises a zipper having detachable halves on opposite sides of said fold line.

3. A multipurpose article according to claim 1 wherein said opening is centrally located on said flexible body.

4. A multipurpose article according to claim 1 wherein said flexible body comprises:

a closure device for closing said opening.

5. A multipurpose article according to claim 4 wherein said closure device comprises:

a complementary pair of hook and loop fasteners, so that said opening can be closed when the flexible body is used as a sleeping bag.

6. A multipurpose article according to claim 4 wherein said flexible body has a pair of layers, one of them being waterproof.

7. A multipurpose article according to claim 1 wherein said flexible body comprises:

a hood attached at said opening for covering a person's head.

8. A multipurpose article according to claim 1 wherein said flexible body comprises:

a pouch arranged to be inverted in order to hold said flexible body in a folded condition.

9. A multipurpose article according to claim 8 wherein said flexible body has a pair of layers, said pouch being attached to one of said layers, the other one of the layers being waterproof.

10. A multipurpose article according to claim 8 wherein said pouch is located adjacent said opening.

11. A multipurpose article according to claim 10 wherein said opening is centrally located.

12. A multipurpose article according to claim 11 wherein said peripheral fastener is operable to hold said flexible body folded along said fold line, said pouch being located across said fold line contiguous to said opening, said opening being located across the center of said fold line.

13. A multipurpose article according to claim 11 wherein said pouch comprises a carrying handle.

14. A multipurpose article according to claim 1 wherein said flexible body comprises:

a hood attached at said opening for covering a person's head; and a pouch having a pair of layered pockets, a first one of them arranged to be inverted in order to hold said flexible body in a folded condition, a second one of said pockets opening at said hood and sized to receive and store said hood.

15. A multipurpose article according to claim 14 wherein said second one of said pockets overlays said first one of said pockets.

16. A multipurpose article according to claim 15 wherein said pouch comprises a handle.

17. A multipurpose article according to claim 11 wherein said flexible body has a length and a width that are integral multiples of the length and width, respectively, of said pouch.

18. A multipurpose article according to claim 1 wherein said peripheral fastener is operable to hold said flexible body folded along said fold line, the length of said flexible body along said fold line being greater than a width dimension transverse to said fold line.

19. A multipurpose article for providing a convertible personal cover, comprising:

a planar flexible body having a pouch arranged to be inverted in order to store said flexible body in a gathered condition, said flexible body having (a) an opening sized to permit passage of a person's head through said flexible body, and (b) a hood attached at said opening for covering a person's head, said pouch being contiguous to said hood for storing said hood in said pouch with said body in an unfolded condition.

20. A multipurpose article according to claim 19 wherein said opening is centrally located on said flexible body.

21. A multipurpose article according to claim 19 wherein said flexible body comprises:

a closure device for closing said opening.

22. A multipurpose article according to claim 21 wherein said closure device comprises: a complementary pair of hook and loop fasteners, so that said opening can be closed when the flexible body is used as a sleeping bag.

23. A multipurpose article according to claim 21 wherein said flexible body has a pair of layers, one of them being waterproof.

24. A multipurpose article according to claim 19 wherein said flexible body comprises:

a pouch arranged to be inverted in order to hold said flexible body in a folded condition.

25. A multipurpose article according to claim 24 wherein said flexible body has a pair of layers, said pouch being attached to one of said layers, the other one of the layers being waterproof.

26. A multipurpose article according to claim 24 wherein said pouch is located adjacent said opening.

27. A multipurpose article according to claim 26 wherein said opening is centrally located.

28. A multipurpose article according to claim 27 wherein said pouch comprises a carrying handle.

29. A multipurpose article according to claim 19 wherein said flexible body comprises:

a hood attached at said opening for covering a person's head; and a pouch having a pair of layered pockets, a first one of them arranged to be inverted in order to hold said flexible body in a folded condition, a second one of said pockets opening at said hood and sized to receive and store said hood.

30. A multipurpose article according to claim 29 wherein said second one of said pockets overlays said first one of said pockets.

31. A multipurpose article according to claim 30 wherein said pouch comprises a handle.

32. A multipurpose article according to claim 27 wherein said flexible body has a length and a width that are integral multiples of the length and width, respectively, of said pouch.

33. A multipurpose article for providing a convertible sleeping bag, comprising:

a planar flexible body having a pouch arranged to be inverted in order to store said flexible body in a folded condition, said flexible body having a peripheral fastener arranged to hold said flexible body in a folded condition about a fold line to form a sleeping bag that is more than twice as wide as said pouch, said pouch being located across said fold.

34. A multipurpose article according to claim 33 wherein said flexible body has four edges, said peripheral fastener (a) being operable to hold said flexible body folded along said fold line, and (b) having a pair of complementary linking devices separately located on opposite sides of said fold line to partially extend (i) along an opposite pair of said four edges located on opposite sides of said fold line, and (ii) along disjoint portions of a common one of said four edges between said opposite pair.

35. A multipurpose article according to claim 34 wherein said peripheral fastener comprises a zipper having detachable halves on opposite sides of said fold line.

36. A multipurpose article according to claim 33 wherein said flexible body has a pair of layers, one of them being waterproof.

37. A multipurpose article according to claim 33 wherein said flexible body has a pair of layers, said pouch being attached to one of said layers, the other one of the layers being waterproof.

38. A multipurpose article according to claim 33 wherein said pouch is located across said fold line.

39. A multipurpose article according to claim 33 wherein said pouch comprises a carrying handle.

40. A multipurpose article according to claim 33 wherein said flexible body has a length and a width that are integral multiples of the length and width, respectively, of said pouch.

41. A multipurpose article according to claim 33 wherein said peripheral fastener is being operable to hold said flexible body folded along said fold line, the length of said flexible body along said fold line being greater than a width dimension transverse to said fold line.

42. A method for providing a sleeping bag and personal cover with a planar flexible body having an opening and four peripheral edges consisting of a first, a second, a third, and a fourth peripheral edge, said first and said third peripheral edges being transverse to both said second and said fourth peripheral edges, comprising the steps of:

placing said flexible body on a person's shoulders with the person's head passing through the opening of said flexible body at a position spaced from said four peripheral edges;

removing said flexible body from the person's shoulders; and folding said flexible body into a sleeping bag having three closed edges and one open edge by peripherally fastening together portions of said first, said second and said fourth peripheral edges, said first peripheral edge being folded in half and longitudinally fastened to form one of said three closed edges, the other two closed edges being formed by longitudinally fastening said second and said fourth peripheral edges together, said third peripheral edge being left unfastened to form the open edge of the sleeping bag.

43. A method according to claim 42 wherein said opening is centrally located on said flexible body, and wherein a hood is attached at said opening, the method comprising the step of:

pushing said hood through said opening after removal of said flexible body from the person's shoulders.

44. A method according to claim 42 comprising the step of:

closing said opening after removal of said flexible body from the person's shoulders.

45. A method according to claim 42 wherein said flexible body has a pouch, the method comprising the step of:

inverting the pouch and storing said flexible body therein in a folded condition.

* * * * *